US005336973A

United States Patent [19]

Leroux et al.

[11] Patent Number: 5,336,973

[45] Date of Patent: Aug. 9, 1994

[54] SYSTEM MAKING IT POSSIBLE TO CONTROL THE SHAPE OF A CHARGED PARTICLE BEAM

[75] Inventors: Thierry Leroux, Ips; Christophe Py, Grenoble, both of France

[73] Assignee: Commissariat a l'Energie Atomique, Paris, France

[21] Appl. No.: 999,227

[22] Filed: Dec. 31, 1992

[30] Foreign Application Priority Data

Dec. 31, 1991 [FR] France ..... 9116401

[51] Int. Cl.[5] ..... H01J 29/46

[52] U.S. Cl. ..... 315/14; 313/447; 313/452

[58] Field of Search ..... 315/14, 382; 313/336, 313/447, 448, 310, 337, 452, 446; 257/10

[56] References Cited

U.S. PATENT DOCUMENTS

| | | | |
|---|---|---|---|
| 4,370,797 | 2/1983 | van Gorkom et al. | 313/303 |
| 4,682,074 | 7/1987 | Hoeberechts et al. | 313/444 |
| 4,874,981 | 10/1989 | Spindt | 313/309 |
| 4,881,006 | 11/1989 | Hedrick | 313/450 |

FOREIGN PATENT DOCUMENTS

| | | |
|---|---|---|
| 0184868 | 6/1986 | European Pat. Off. . |
| 0395158 | 10/1990 | European Pat. Off. . |
| 1489884 | 9/1965 | Fed. Rep. of Germany . |
| 1-100842 | 4/1989 | Japan . |
| 2013398 | 8/1978 | United Kingdom . |
| 2054959 | 2/1981 | United Kingdom . |

*Primary Examiner*—Gregory C. Issing

[57] ABSTRACT

A system for controlling the shape of a charged particle beam. The particle beam is emitted from a source (58) of the said particles. Said source is associated with a collecting electrode which collects the particles. The system comprises at least one resistive zone (56) and at least two control electrodes (52, 54). The resistive zone and the control electrodes are arranged substantially at the same level as the source. The control electrodes are also placed on either side of the resistive zone and serve to polarize the latter. The electrical resistance profile of the resistive zone is chosen in such a way that it has the potential distribution so that it is possible to obtain the desired shape of the beam from the source when the control electrodes are appropriately polarized.

21 Claims, 10 Drawing Sheets 88
80
81
86
84
84
86
82
86
88
84
81
88

Figure 1:
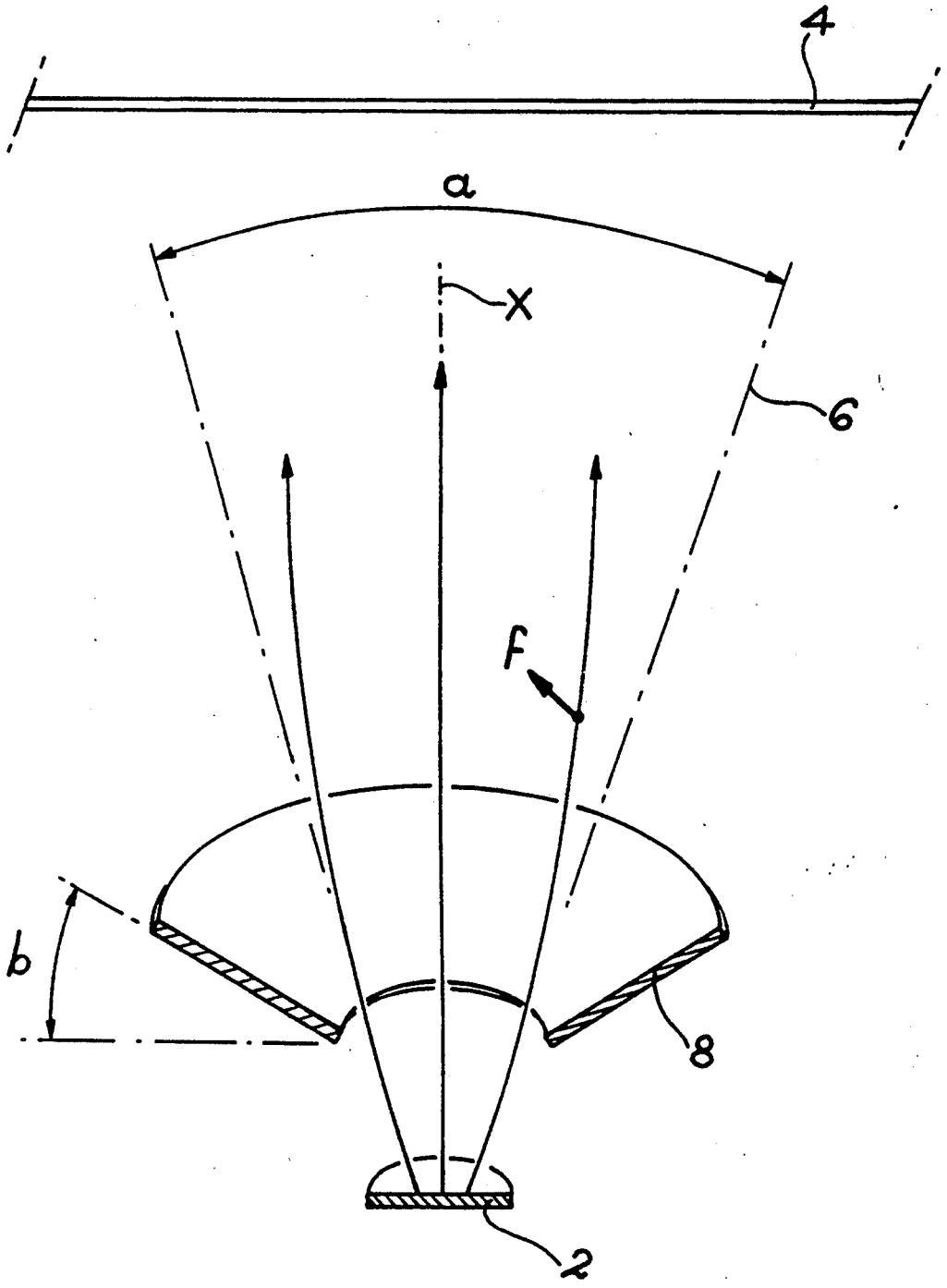
FIG. 1 PRIOR ART

92
96
94
90a
80
81
90b 90b
90a
82
90a
90b
96
92
96
92
94
81
94

84
98
88

84
84
88
100
88

84b
84a
81
80
84b
81
84a
88
86
88
86
81
82
86

84a
84b
88

84b
84a
84b
98
88
84a
88
84b
88
100

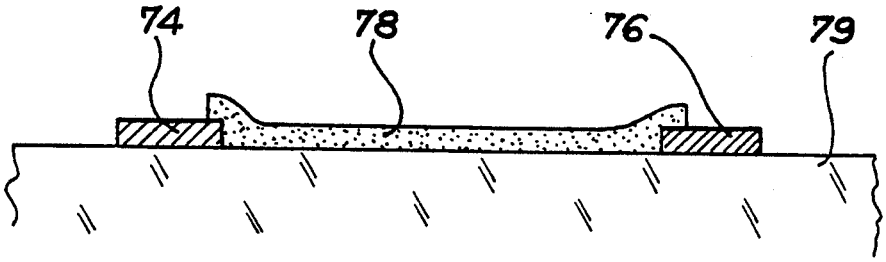
FIG.8A
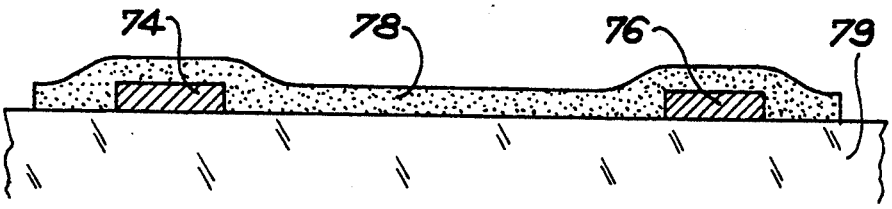
FIG.8B
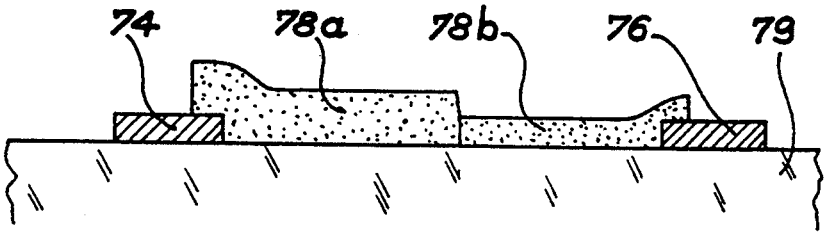
FIG 8C
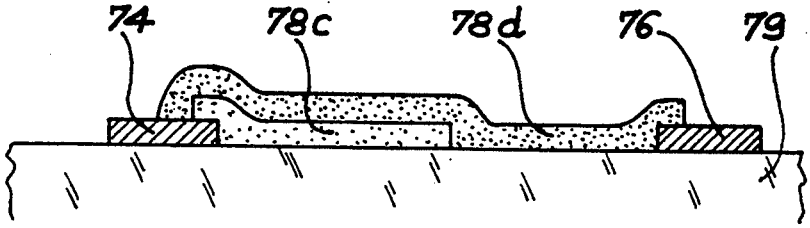
FIG. 8D
FIG. 9
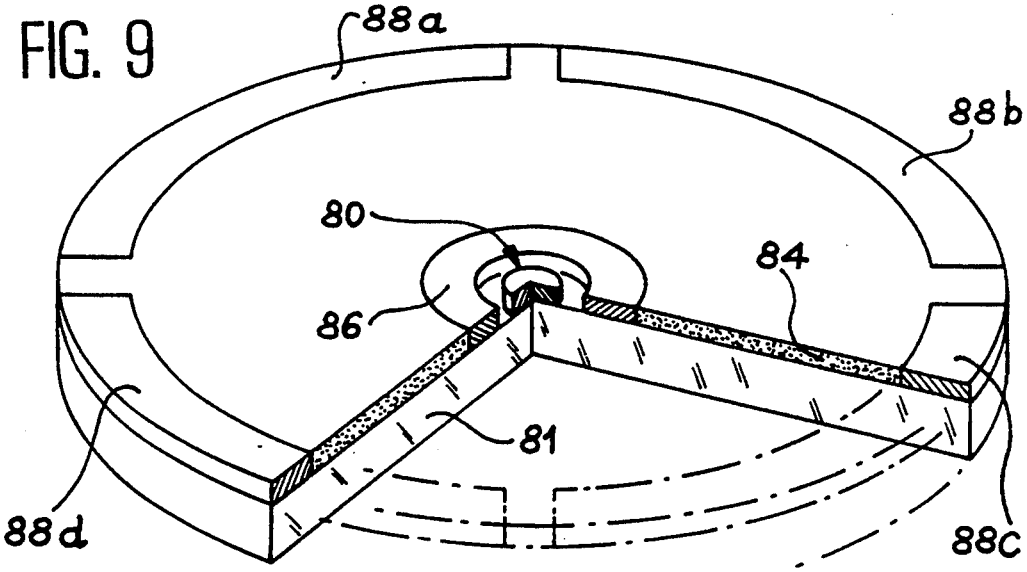

SYSTEM MAKING IT POSSIBLE TO CONTROL THE SHAPE OF A CHARGED PARTICLE BEAM

DESCRIPTION

The present invention relates to a system making it possible to supervise or more precisely control a beam of charged particles, e.g. electrons.

This system makes it possible to control the appearance or more specifically the shape of the charged particle beam and in certain particular cases also control the orientation of said charged particle beam.

The present invention specifically applies to the focusing of an electron beam from a planar source and in particular a micropoint source or a heating filament. The invention is also applicable to electron guns for cathode ray tubes, as well as to beans scanned by laser excitation or sources for vacuum gauges.

Systems making it possible to control the shape of a charged particle beam are already known. This is the case in most electron guns, a focusing optics or also known as refocusing optics is used for obtaining a reduced diameter beam, or in which the electrons have parallel trajectories or paths.

Numerous applications, e.g. the cathode ray tube of a television screen, require the use of a fine electron beam for obtaining an image with a sufficient resolution for television purposes.

In other cases, e.g. in reverse photoemission (cf. documents (1) and (2) which, like the other documents referred to hereinafter, are given at the end of the present description) the trajectories of the electrons must be parallel, so that all the electrons have the same velocity, which is an important parameter of the measurement.

Finally, in certain cases, it may be useful for obtaining at a precise point a minimum size spot in order to have a local high current density. This is e.g. the case of a compact semiconductor laser of the electronic pumping type.

Several methods exist for focusing an electron beam.

A first known method consists of accelerating the beam, which reduces the relative angular moment of each electron trajectory. This can easily be obtained by means of an electrode known as a Wehnelt electrode, which faces the electron source (this is what is done in a conventional television cathode ray tubs) or a varyingly complex array of electrostatic lenses (cf. document (3)), e.g. obtained by juxtaposing several cylindrical electrodes centred on the electron beam.

The first method is very widely used for high energy electrons (like those used in conventional cathode ray tubes), because the focusing and accelerating functions are combined in this case.

A second known method consists of driving back towards the desired propagation axis for the electrons those which diverge, i.e. move away from said axis. Thus, it is known to use for the purpose of focusing electron beams from naturally divergent sources, an electrode known as a Pierce electrode and which is diagrammatically shown in FIG. 1.

FIG. 1 shows an electron source 2, which emits electrons in the direction of a collecting electrode 4 (anode), which is planar in FIG. 1. The desired propagation axis for the electrons carries the reference X and said axis is perpendicular to the anode 4.

Thus, the source 2 emits a divergent electron beam 6, whose initial aperture, aperture which the beam would have in the absence of refocusing) carries the reference a in FIG. 1. The Pierce electrode making it possible to focus the divergent beam emitted by the source 2 carries the reference 8.

The electrode 8 is raised to a regulatable potential, which is negative compared with the potential level at which are emitted the electrons, is shaped like a truncated cone, whose axis is the axis X and whose cone semi-angle is 67.5° (so that the plot of said truncated cone in a plane containing the axis X forms, with a plane perpendicular to axis X, an angle b of 22.5°).

Moreover, with the electrodes 2 and 4, the electrode 8 produces an electric field exerting on each divergent electron a force f driving back said divergent electron towards the axis X.

It is pointed out that the system diagrammatically shown in FIG. 1 can also have a not shown accelerating anode, which fulfils the conventional function of a Wenhelt electrode.

In connection with Pierce optics, reference can be made to documents (4), (5) and (6).

This second known method has various advantages. It does not require the use of high voltages and is therefore preferable to the first known method, when it is e.g. wished to have low energy electrons. For focusing divergent electrons, it only uses a single cathode (electrode 8) and an anode, as well as optionally a Wenhelt electrode. It makes it possible to obtain very good focusing results.

However, the second known method suffers from disadvantages, particularly in the case where use is made of planar emissive cathodes and in particular cold cathodes ( cf. documents (7), (8) and (9)).

A first difficulty is that of installation. The electron source and the focusing system must be very carefully positioned and secured with respect to one another, which can give rise to complex, unstable assemblies. A second disadvantage is the overall dimensions of the focusing system, which can be very large and unfavourably compensates the small overall dimensions of the planar sources.

The present invention aims at obviating these disadvantages by proposing a system making it possible to control the shape of a charged particle beam, said system being able to have small overall dimensions and can be manufactured by microelectronic methods.

Thus, more particularly in the case of a micropoint source which is manufacturable by said microelectronic methods, it is possible to produce at the same time as said source the system according to the invention and integrate the latter into the substrate on which said source is deposited. In this way, it is no longer necessary to mechanically assemble the source and the system, as was the case in the second known method referred to hereinbefore.

More specifically, the present invention relates to a system making it possible to control the shape of a charged particle beam, which has come from a particle source, said source being associated with a collecting electrode for collecting these particles, said system being characterized in that it comprises at least one resistive zone and at least two control electrodes, said resistive zone and said control electrodes being arranged substantially at the same level as the source, said control electrodes also being placed on either side of the resistive zone and serve to polarize the latter, the electric resistance profile of the resistive zone being chosen so as to have the potential distribution making it possible to obtain the desired shape of the beam from the source, when the control electrodes are appropriately polarized.

The shape of the charged particle bean is modified as a function of the application chosen for said bean and in particular as a function of the structure of the collecting electrode (which is dependent on said application).

In the present invention, the collecting electrode can be planar or non-planar.

The number and shape of the control electrodes, as well as the electrical potentials applied thereto can be experimentally determined as a function of the shape which it is wished to give to the particle beam, optionally with the aid of a simulation software.

It should be noted that it is not possible to reconstitute the field imposed by a non-planar refocusing electrode, e.g. of the Pierce electrode type, unless the potential distribution in a plane level with the source is continuously variable. A set of separate electrodes only makes it possible to obtain such a distribution in an approximate manner. However, the present invention, which uses at least one resistive zone, makes it possible to obtain this continuously variable distribution or even a distribution which is continuously variable in parts.

According to a special embodiment of the system according to the invention, said system comprises a plurality of resistive zones respectively placed between two control electrodes, said resistive zones then being separated by at least one control electrode. In the case where two resistive zones are separated from one another by two separate control electrodes, it is possible to produce a discontinuous potential profile at the location of said electrodes. In the case where two resistive zones are separated by a single control electrode, it is possible to produce a continuous, but not necessarily monotonic potential profile.

According to another embodiment, the different resistive zones have different resistance profiles.

According to another special embodiment, each resistive zone comprises a plurality of elementary resistive zones, whose respective electrical resistances differ from one another and which are between two control electrodes.

In the latter case, the respective thicknesses of these elementary resistive zones and/or respective resistivities of these elementary resistive zones and/or the respective resistive surfaces of these elementary resistive zones with equal length can differ from one another and are chosen so as to obtain the desired electrical resistances.

In a special embodiment of the invention, the source comprises a gate for extracting particles and said gate constitutes one of the control electrodes and is located in the centre of the system, each other control electrode surrounding the source.

In another special embodiment, each control electrode surrounds the source.

At least one control electrode surrounding the source can be discontinuous and forms a plurality of elementary control electrodes. In this case, apart from the control of the bean shape, the system also makes it possible to control the orientation of said beam by using appropriate electrical potentials, as will be shown hereinafter.

In another special embodiment, the source comprises a particle extraction gate and has an elongated shape in one direction, the gate constituting one of the control electrodes and is located in the centre of the system and the system comprises at least one other control electrode, having an elongated shape in said direction and located on each side of the source and at least one resistive zone extending between the gate and the other control electrode of each side of the source.

In another special embodiment, the source has an elongated shape in one direction and the system comprises at least two control electrodes having an elongated shape in said direction and located on either side of the source, as well as at least one resistive layer placed between the two electrodes of each side of the source.

In the two latter embodiments, the system also makes it possible to control the orientation of the beam, as well as its shape.

Moreover, in the case of a source having an elongated shape, the number of electrodes and resistive layers on each side of the source is not necessarily the same.

In an advantageous embodiment of the system according to the invention, said system is integrated into the charged particle source when the latter is a planar source.

Finally, the control electrodes can be planar and located substantially in the plane of said source.

The invention is described in greater detail hereinafter relative to non-limitative embodiments and with reference to the attached drawings, where in show:

FIG. 1, already described, a diagrammatic view of a known system making it possible to focus a divergent electron beam.

Figure 2:
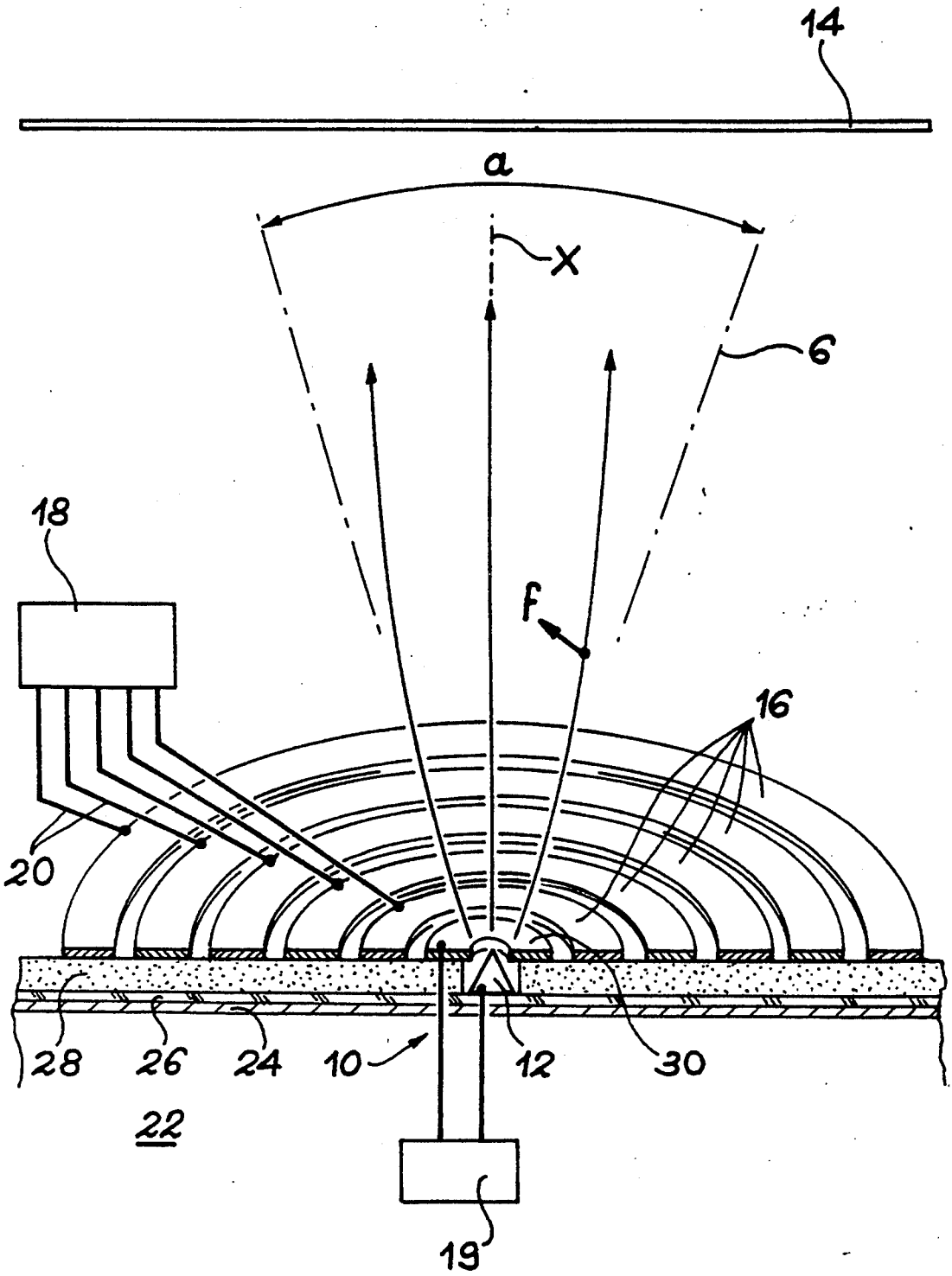

FIG. 2 a diagrammatic view of a focusing system useful for the understanding of the invention and having control electrodes in the form of concentric rings.

Figure 3:
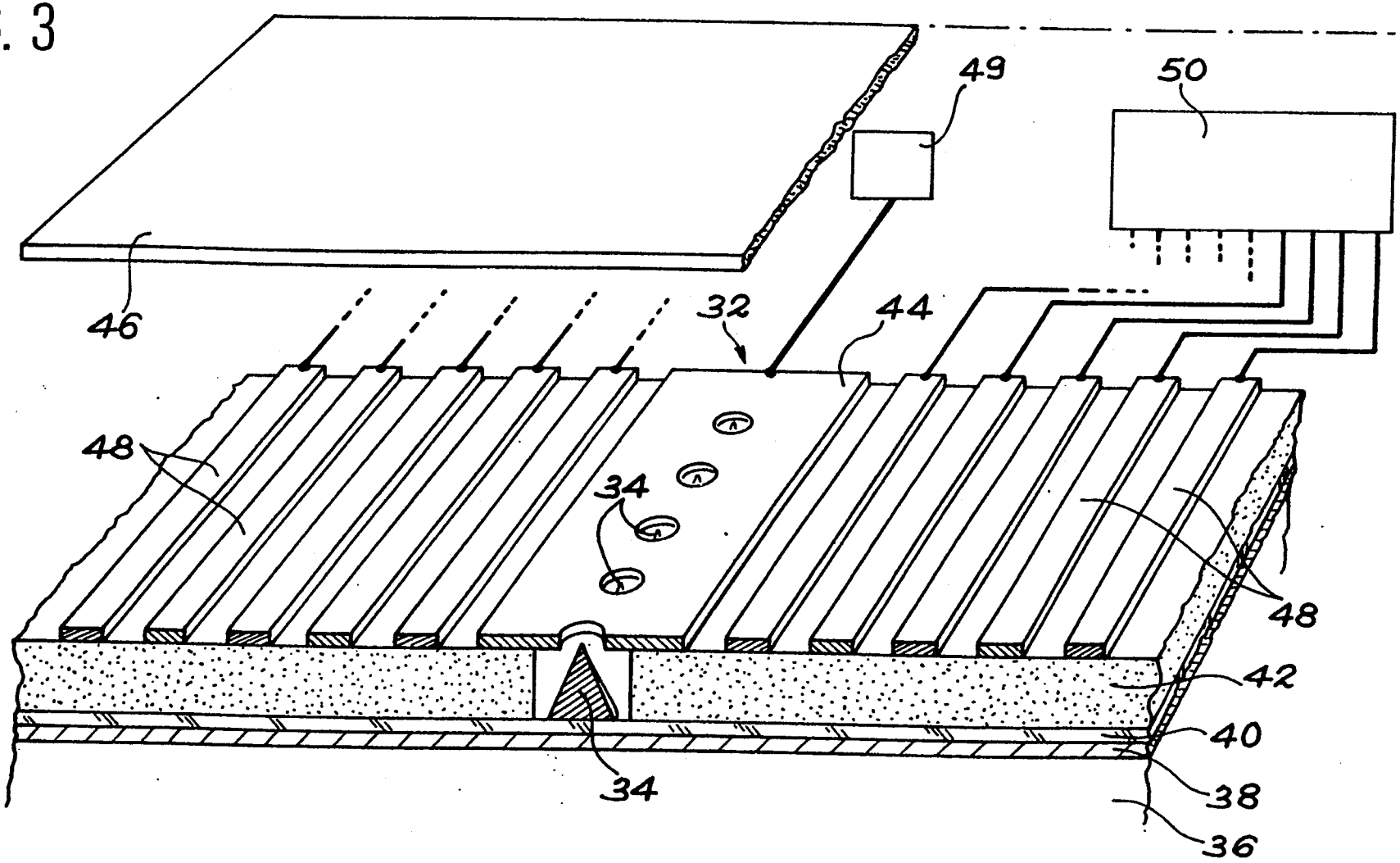

FIG. 3 a diagrammatic view of another focusing system useful for the understanding of the invention and having elongated control electrodes.

Figure 4:
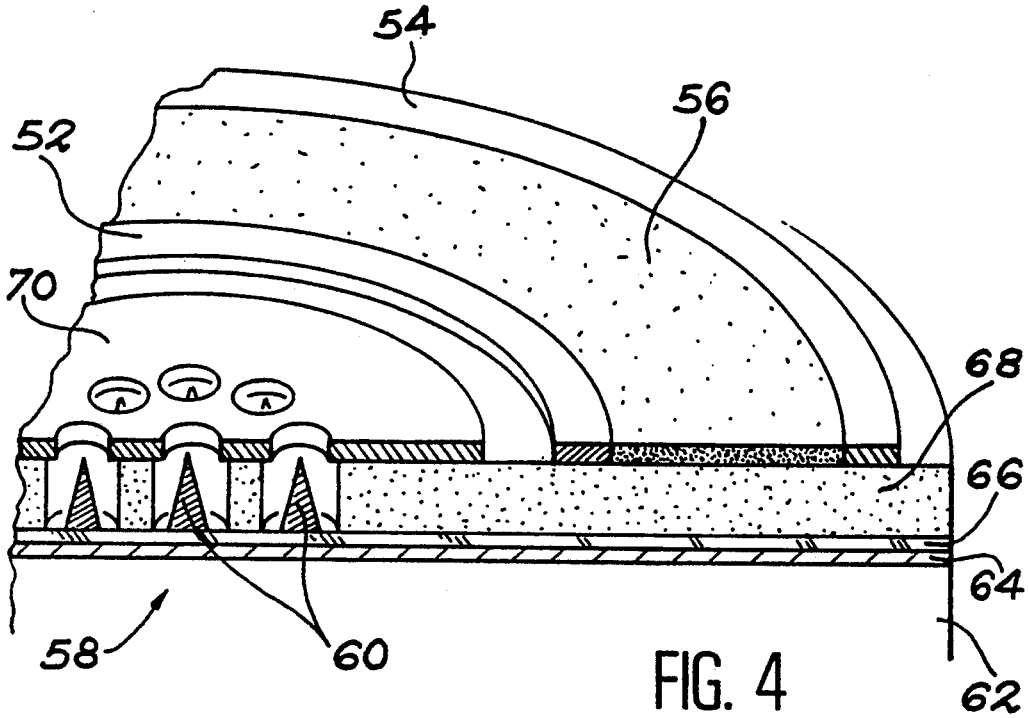

FIG. 4 a diagrammatic view of a special embodiment of the system according to the invention having a resistive zone between two control electrodes.

FIGS. 5A–F and with the aid of graphs, various ways of obtaining said resistive zone.

Figure 6:
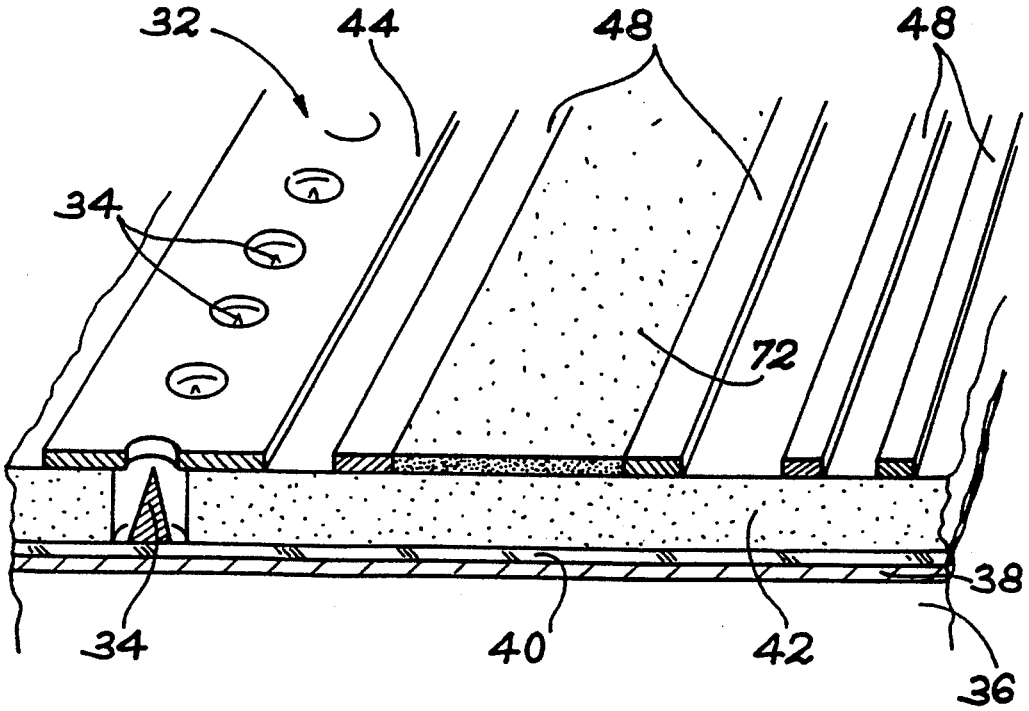
Figure 5A:
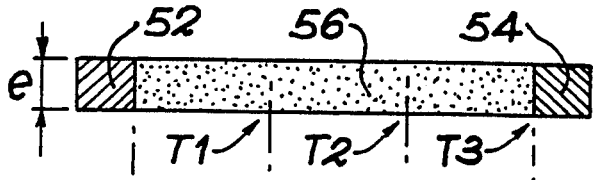
Figure 5B:
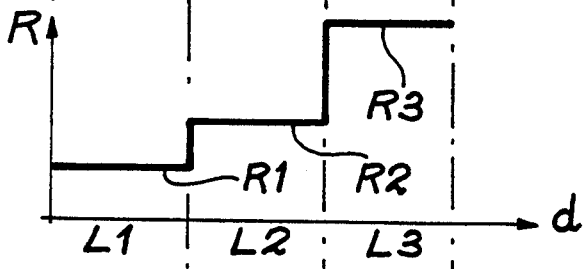
Figure 5C:
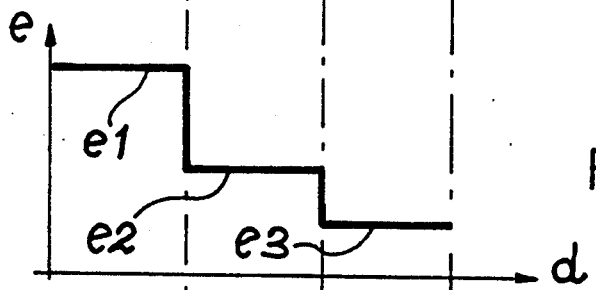
Figure 5D:
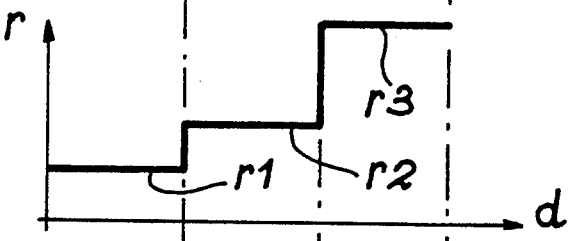
Figure 5E:
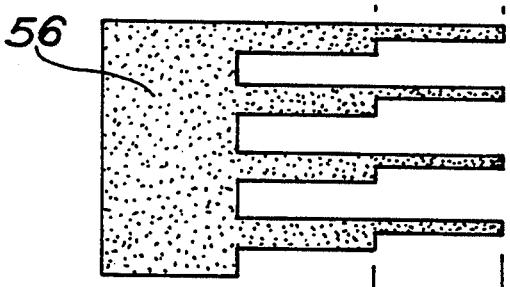
Figure 5F:
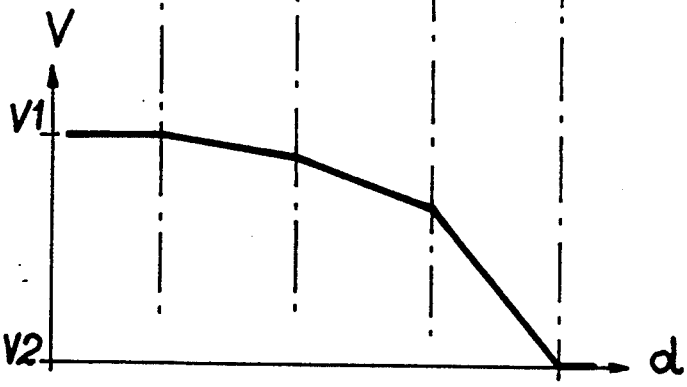
Figures 7A, 7B, 7C, 7D, 7E, 7F, 7G, 7H, 7I, 7J:
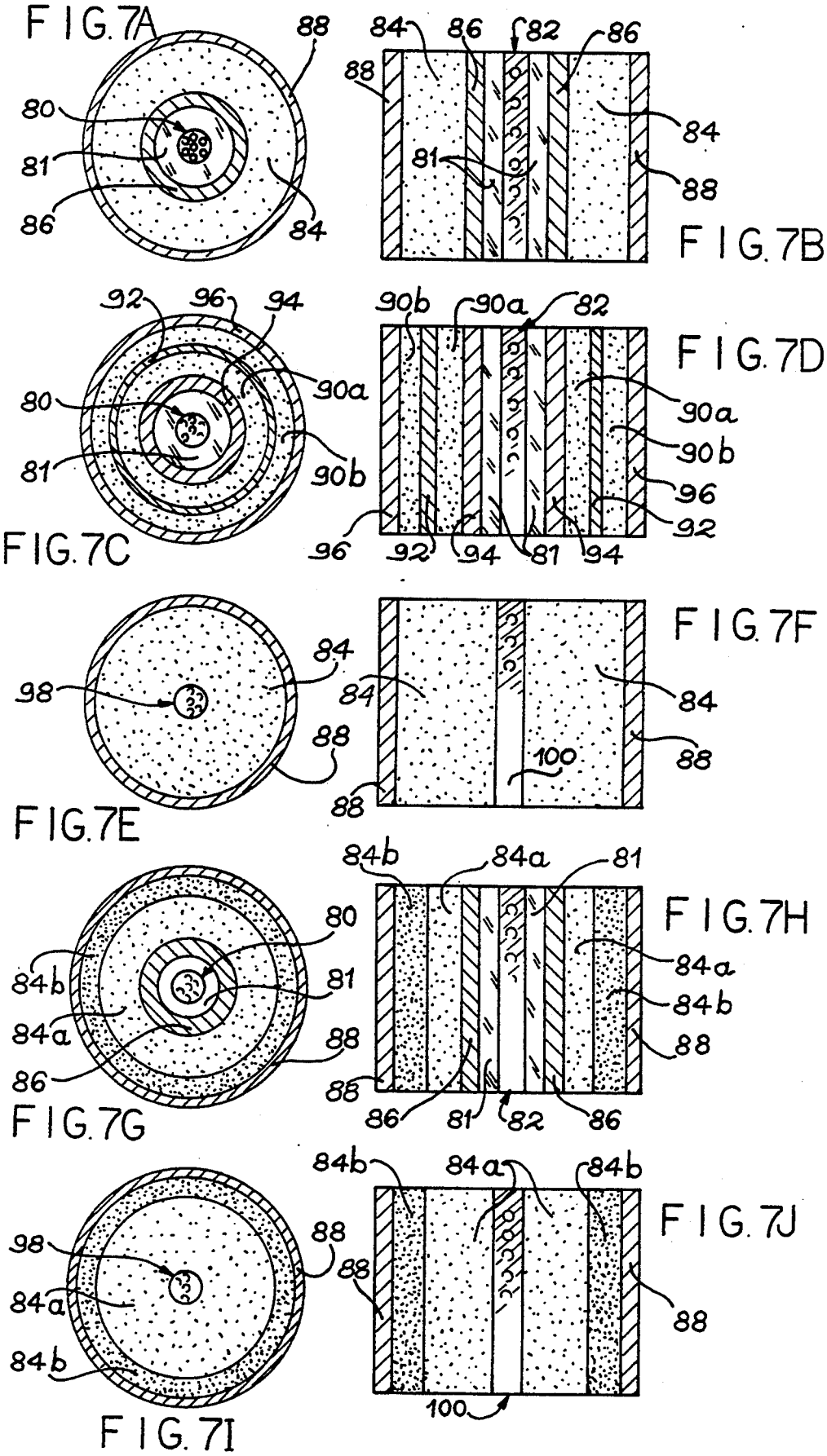

FIG. 6 a diagrammatic view of another special embodiment of the system according to the invention having other control electrodes, in addition to the two electrodes between which is located the resistive zone.

FIGS. 7A–J and partially various embodiments of the system according to the invention.

FIGS. 8A–D diagrammatically various methods for obtaining resistive layers by deposition with buried or non-buried electrodes and for layers having a uniform or non-uniform thickness.

Figure 10:
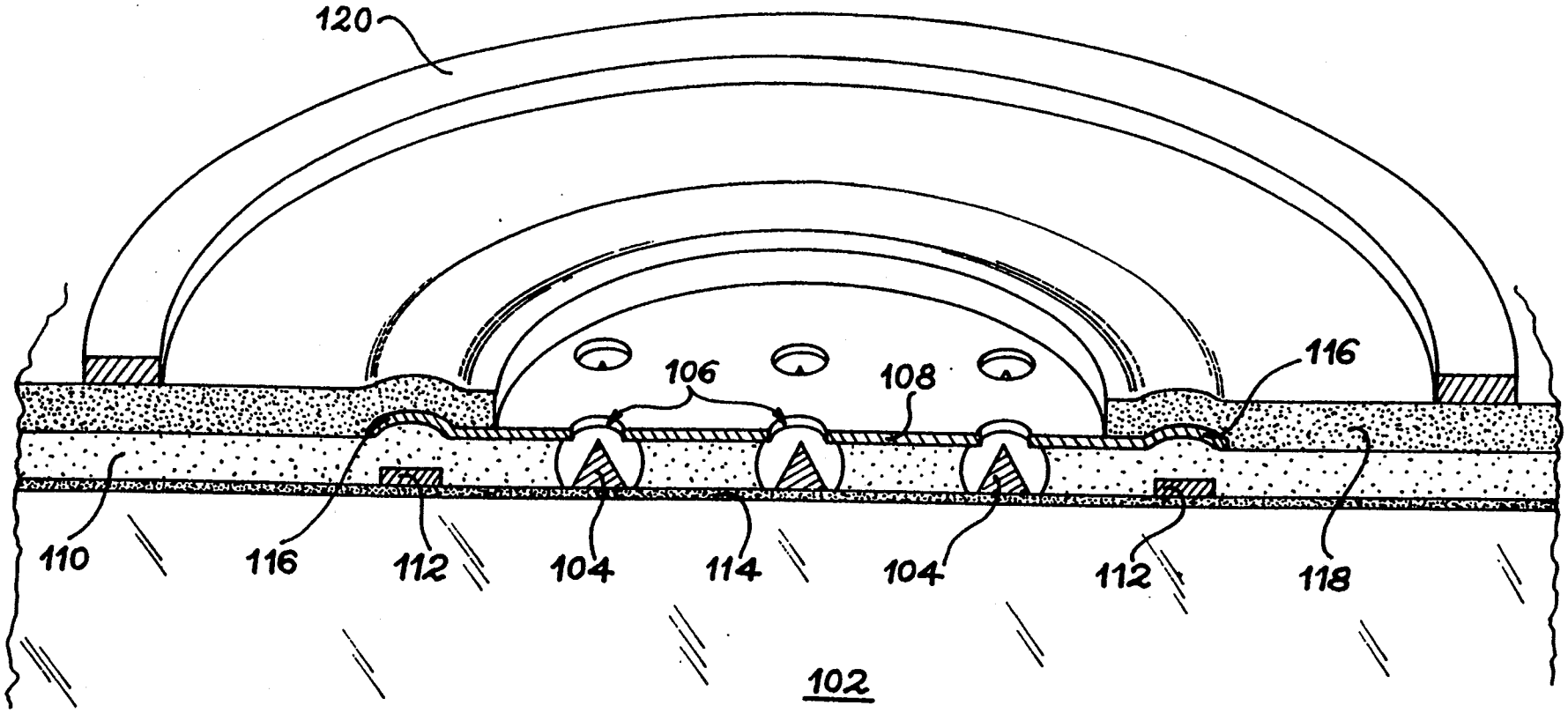

FIGS. 9 & 10 diagrammatically and partially other systems according to the invention.

Figure 11:
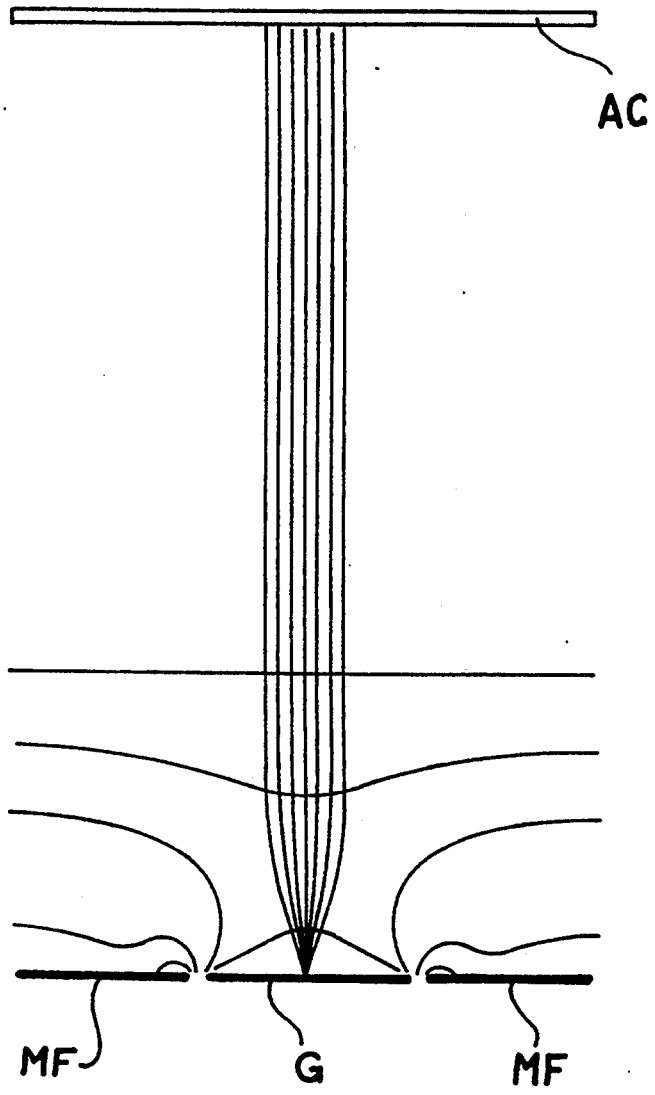

FIG. 11 the simulation of the focusing of an electron beam coming from a point source by means of a focusing system.

Figure 12:
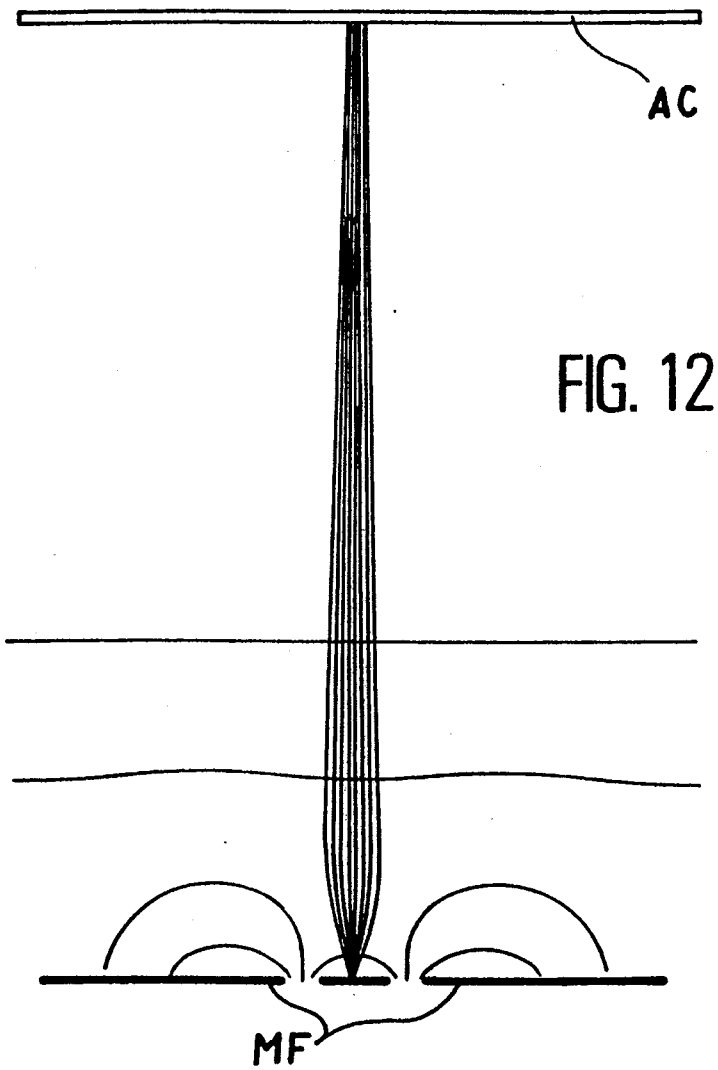

FIG. 12 the simulation of the focusing at one point of an electron beam coming from a point source with the aid of another focusing system.

Figure 13:
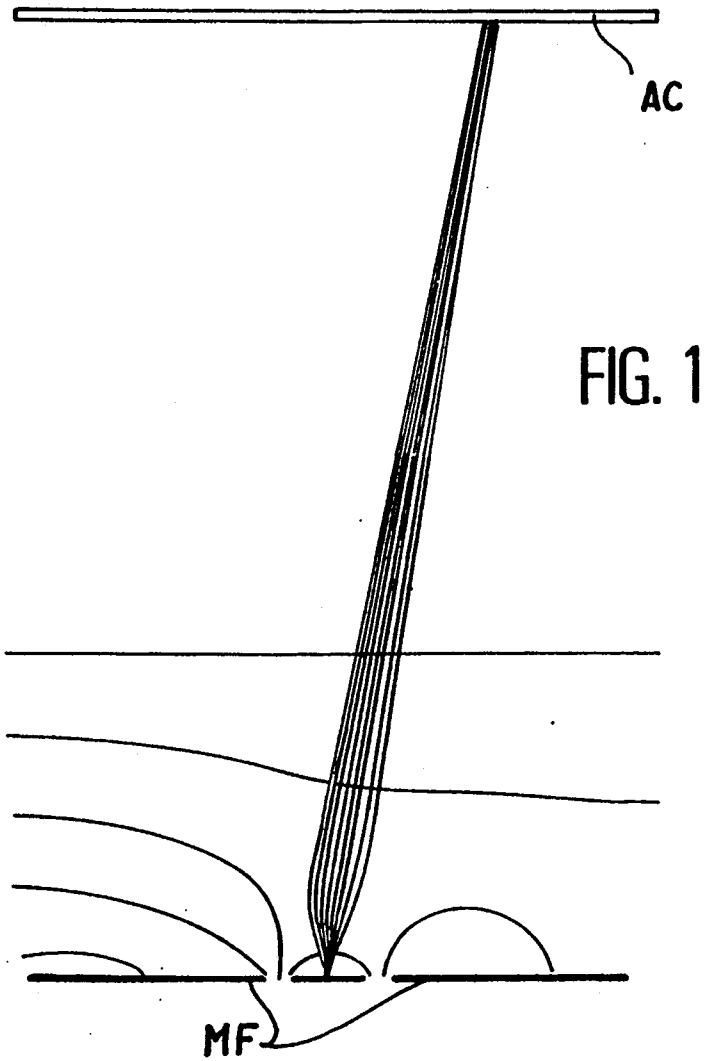

FIG. 13 the simulation of the deflection and focusing at one point and in simultaneous manner of an electron beam from a point source by means of another focusing system having elongated control electrodes.

FIG. 2 diagrammatically a system useful for the understanding of the invention and which makes it possible to focus an electron beam emitted by an electron source 10. This source 10 is e.g. a planar source such as a source having a single micropoint 12 but, in other constructions, it could obviously have several micropoints.

Therefore the source can be a point source, i.e. having a shall emissive surface compared with that of the refocusing means or conversely can be extensive.

The source 10 corresponds to the source 2 of FIG. 1 and FIG. 2 also shows the axis X along which it is desired that the beam emitted by the source propagates, as well as the initial aperture a of said electron beam. These electrons are collected by an anode 14, which is also planar in the embodiment shown in FIG. 2.

The aim is to focus the electron beam by driving back the divergent electrons towards the axis X, but the force f which drives back said electrons towards the axis X is obtained by means of control electrodes 16, which are raised to appropriate electrical potentials. Therefore the control electrodes 16 replace the Pierce electrode 8 of FIG. 1.

The electrode 8 is raised to an electric potential V making it possible to produce an electric field, which drives back the divergent electrons towards the axis X.

The control electrodes 16 which, in the embodiment shown, are in the plane of the source 10 and which are spaced from one another, approximately simulate a continuous electrical potential distribution in the plane of the source 10 and make it possible to approximately recreate the shape of the equipotential V imposed by the Pierce electrode 8 of FIG. 1. Thus, approximately the seine electric field shape and therefore the same effect on the electron beam which is emitted by the source and which is initially divergent are obtained.

FIG. 2 also shows polarizing means 18 making it possible to raise the various control electrodes 16 to electric potentials which are different from one another and which are negative compared with the potential level at which the electrons are emitted.

FIG. 2 also shows the electrical connections 20 respectively connecting the control electrodes 16 to the polarizing means 18.

In the embodiment shown in FIG. 2, the electron source 10 comprises an electrically insulating substrate 22, e.g. of glass, on which is formed a cathode contact layer 24, e.g. of chromium. On the latter is formed a resistive layer 26, e.g. of silicon.

On said layer 26 is formed an electrically insulating layer 28, e.g. of silica, which has a drilled hole in which is located the micropoint 12, e.g. of molybdenum, said micropoint being formed on the resistive layer 26.

Reference can be made to document (7) in connection with said source structure. The source 10 also comprises an extraction gate 30.

Polarizing means 19 are provided for raising said gate 30 to a potential making it possible to extract the electrons from the micropoint 12.

In the embodiment shown in FIG. 2, the axis of the micropoint 12 is the axis X and the extraction gate 30 is disk-shaped and its axis is also the axis X and is perforated in its centre to permit the passage of the electrons extracted from the micropoint 12.

In the embodiment shown in FIG. 2, the control electrodes 16 are ring-shaped, planar electrodes, which are concentric and have the axis X as the common axis. Therefore they are centred on the electron source.

The control electrodes 16 are formed, at the same time as the extraction gate 30, on the insulating layer 28. Thus, the system shown in FIG. 2 is integrated into the source 10.

FIG. 3 diagrammatically shows another system useful for the understanding of the invention and which focuses an electron beam emitted by a planar, elongated source 32.

It is a micropoint source having a row of micropoints 34, which are aligned (but in other constructions several rows of such micropoints could exist ) .

The source shown in FIG. 3 comprises an insulating substrate 36, e.g. of glass, on which is formed a cathode contact layer 38, e.g. of chromium. On the latter is formed a resistive layer 40, e.g. of silicon. On the resistive layer is formed an insulating layer 42, e.g. of silica.

The layer 42 has a row of holes in which are located the micropoints 34, which are e.g. made from molybdenum and formed on the resistive layer 40. The source shown in FIG. 3 also comprises an extraction gate 44 perforated facing the micropoints 34 and making it possible to extract the electrons from the latter. This gate 44 is in the form of a strip, which extends in the alignment direction of the micropoints 34, as can be seen in FIG. 3. An anode 46 for collecting the electrons emitted by the micropoints is positioned facing the source 32.

The system shown in FIG. 3 also comprises control electrodes 48 extending in the alignment direction of the micropoints 34 and positioned on either side of the extraction gate 44. These electrodes 48 are formed at the sane time as the extraction gate 44 on the insulating layer 42.

Thus, the system of FIG. 3 s integrated into the electron source 32.

In the embodiment shown in FIG. 3, the structure formed by this system and the source is symmetrical with respect to the row of micropoints 34 (there is the same number of electrodes 48 on one side of the gate as on its other side ) .

FIG. 3 also shows polarizing means 49 for raising the gate 44 to an appropriate potential permitting the extraction of electrons, as well as polarizing means 50 for raising the control electrodes 48 to independent potentials, which are different freon one another and which make it possible to create an electric field, which causes the focusing of the electron beam emitted by the source 32.

The system described relative to FIGS. 2 and 3 make it possible to approximately simulate a continuous potential variation with the aid of several control electrodes.

However, these systems do not make it possible to reconstitute the field obtained by a non-planar refocusing electrode. The invention also proposes systems using at least one resistive zone between control electrodes in order to obtain a given potential distribution appropriate for the desired shape of the particle beam from the source.

FIG. 4 shows a special embodiment of the system according to the invention, which is simpler and only uses two control electrodes 52, 54, as well as a resistive zone 56 between said electrodes 52, 54 and polarized by the latter. The system shown in FIG. 4 serves to focus an electron beam emitted by an electron source 58 which, in the embodiment shown, is once again a source with micropoints 60.

This source 58 once again comprises an insulating substrate 62 surmounted by a cathode layer 64, itself surmounted by a resistive layer 66 on which are formed the micropoints 60. An insulating layer 68 covers the layer 66 and has holes in which the micropoints 60 are located.

As in the case of FIG. 2, the source of FIG. 4 is circular. On the insulating layer 68 it has a disk-shaped gate 60 perforated facing the micropoint 60.

The system according to the invention shown in FIG. 4 is once again integrated into the source 58.

The control electrodes 54, 54 form concentric rings, whose axis is that of the disk formed by the extraction gate 70.

These electrodes 52 and 54 are formed at the same time as the gate 70 on the insulating layer 68 after the resistive zone 56, e.g. of silicon, has been deposited on the layer 68 between the electrodes 52 and 54, whilst being in contact with said electrodes 52 and 54. The distribution of the potential is dependent on the resistance profile of the zone 56.

A not shown anode is provided facing the source 58 for collecting the electrons emitted by the micropoints 60. Not shown polarizing means are also provided for polarizing the gate 70, so as to extract the electrons and also for polarizing the electrodes 52, 54, so as to focus the divergent beam emitted by the source.

There are several solutions for obtaining the electrical resistance profile of the zone 56 making it possible to focus the electron beam. These various solutions are illustrated by parts A to F of FIG. 5.

Part A of FIG. 5 is a sectional view of the electrodes 52 and 54 and the resistive zone 56 through a plane containing the axis of the source. The distance d from a point to the axis of said source is marked on an axis parallel to the cross-section shown in part A of FIG. 5.

In the embodiment shown in FIG. 5, it is assumed that the resistive zone 56 is formed by three adjacent sections of elementary resistive zones T1, T2, T3 of the respective lengths L1, L2, L3 (considered along the axis shown in part B of FIG. 5). The respective electrical resistances of these sections T1, T2, T3 are designated R1, R2, R3.

An electric resistance profile example is shown in the graph in part B of FIG. 5, where the resistance R1 of section T1 (the closest to the electron source) is lower than the resistance of the sections T2, which is itself lower than the resistance of section T3.

There are in fact three solutions for obtaining such an electric resistance profile on the basis of the formula:

$$R=r\times L\times S^{-1}.$$

This formula is applicable to each section by giving the parameters R, r, L and S the appropriate index (1 or 2 or 3). The parameters R, r, L and S respectively represent the electrical resistance, the resistivity of the material used, the length and cross-section of said section (the cross-section S being a cylindrical surface in the embodiment shown). The graph of part C of FIG. 5 shows the obtaining of the desired resistance profile by respectively giving the sections T1, T2 and T3 thicknesses e1, e2 and 3 such that:

$$e1>e2>e3.$$

In the example shown, e1 is double e2 and e2 is double e3 (S1 is double S2, which is double S3).

As can be seen in part D of FIG. 5, the same electric resistance profile is obtained by respectively giving the sections T1, T2 and T3 resistivities r1, r2 and r3 such that:

$$r1<r2<r3.$$

In the present example, 1 is half r2 and r2 is half r3.

Such resistivity variations are obtained by appropriately varying the doping of the material forming the resistive zone 56 or by using, for each section, different materials.

Part E of FIG. 5, which shows a portion of the resistive zone in plan view, illustrates the fact that it is possible to obtain the same electric resistance profile by zonally etching the resistive zone having an initially uniform thickness in such a way that the resistance of the thus defined section increases in inverse ratio with respect to the remaining resistive surface.

Once again using the above example for equal section lengths, the section T2 has a resistive surface twice smaller than the section T1 and twice larger than the section T3, so that it is two times more resistant than the section T1 and two times less resistant than the section T3.

Thus, part E of FIG. 5 is strictly applicable to a resistive zone between two rectilinear control electrodes, which constitutes a special embodiment applicable to an elongated source e.g. of the type according to FIG. 3.

However, it is possible to transpose the example of part E of FIG. 5 to the case of FIG. 4 by replacing the rectilinear sections by disk-shaped sections.

The graph of part F of FIG. 5 shows the variation of the potential V as a function of the distance d from the electron source. The potential of the electrode 52 is designated V1 and the potential of the electrode 54 is designated V2.

With the resistance profile shown in part B of FIG. 5 and V1>V2, the potential decreases in monotonic manner on passing from section T1 to section T3.

The system according to the invention diagrammatically shown in FIG. 6 differs from that shown in FIG. 3 by the fact that a resistive zone 72 is formed between the two control electrodes 48 located on one side of the row of micropoints and which are closes to said micropoints, a resistive zone 72 also being formed between the two control electrodes closest to the row of micropoints, but located on the other side of the latter.

Thus, there are not only two control electrodes between which is located the resistive zone, but also other control electrodes (which are also raised to appropriate potentials for focusing the electron beam).

In a not shown, special embodiment derived from the system of FIG. 2, the resistive zone is formed between the two concentric electrodes closes to the electron source 10.

The system according to the invention is usable for applications other than the focusing of an electron beam.

In the case where the electron source has smaller dimensions compared with the system according to the invention and which equips said source, it is possible to obtain a spot concentrated or refocused at a precise location, in place of a parallel electron beam. It is possible to concentrate the beam at the desired location by appropriately regulating the potentials of the control electrodes.

In the case where working takes place with a system according to the invention and having an elongated shape (cf. FIG. 6), it is possible to impose different electric potential profiles at two or more resistive zones on either side of the electron source. The electron beam then undergoes a deflection in addition to a focusing. Thus, a system is available permitting the deflection of an electron beam.

The interest of the control electrode shown in FIGS. 4 and 6 is that they can be directly formed on an emissive cathode.

Thus, a focusing optics is obtained, which is integrated into the electron source, which can be perfectly positioned by etching and which adds no increased dimensions to the already small dimensions of the source. Thus, a very compact assembly is obtained which, in certain cases, also permits the deflection of the electron beam.

Hereinafter consideration will be given to various embodiments of the invention.

It has been shown that the invention makes it possible to control a charged particle bean from a source for the said particles (e.g. an ion source) by recreating the equipotentials which would be obtained by using one or more non-planar refocusing electrodes like the Pierce cathode. These non-planar cathodes have hitherto been the only cathodes making it possible to strictly refocus beans having a random shape.

Particularly in the case of planar sources, the invention makes it possible to recreate the field necessary for controlling the emitted beam with the aid of a system which can be formed by microelectronic methods.

The planar sources whose beams are to be controlled can be of a random shape, as a function of the production technologies possibilities for said sources. The shapes of the systems making it possible to control the beats from said sources can also be of a random nature.

Hereinafter is shown in exemplified manner inventive embodiments of elongated or point sources, with respectively concentric or elongated beam control systems on either side of the sources.

In order to obtain a continuously variable potential distribution in the plane of such sources, it has been seen that the invention uses at least one resistive zone polarized at its ends by two electrodes. These can be seen (cf. part A of FIG. 8, where the electrodes are designated 74 and 76, where the resistive zone carries the reference 78 and where the substrate on which said zone and the electrodes are formed carries the reference 79 ) or the said electrodes can be buried (cf. part B of FIG. 8).

To obtain the desired potential distribution, it is possible to use one or more optionally different resistive zones respectively formed by one or several elementary resistive zones of different resistivities obtained by various methods and/or it is possible to use one or more resistive zones (separated by one or more control electrodes) having the same or different resistivities.

1) The method consisting of forming one or more resistive zones separated by electrodes polarized to carefully chosen potentials is diagrammatically illustrated by parts A to F of FIG. 7. Parts A, C and E relate to circular electrodes surrounding a source 80, whilst parts B, D and F relate to rectilinear electrodes placed on either side of a rectilinear source 82. The reference 81 represents the substrate on which the source and electrodes are formed. In the drawings, the resistive zones are symmetrically arranged on either side of the source, but it is also possible to use asymmetrical beam control means. It is thus possible to obtain potential profiles which are linear in parts.

In a first embodiment (parts A and B of FIG. 7), a single resistive zone 84 polarized by two electrodes 86, 88 is defined (it should be noted that for the part B the structure 84-86-88 is repeated on either side of the source 82).

In a second embodiment (parts C and D of FIG. 7), there are two resistive zones 90*a*, 90*b* separated by a polarizing electrode 92, two other polarizing electrodes 94, 96 are deposited on either side of the resistive zones to make it possible to obtain two independent zones, where potential gradients can be imposed independently of one another.

It should be noted that for part D, the structure 90*a*, 90*b*-92-94-96 is repeated on either side of the source 82.

As a variant, it would be possible to form two zones 90*a*, 90*b* of different resistances separated by the electrode 92 and surrounded by the electrodes 94 and 96.

It would also be possible to have several resistive zones respectively surrounded by control electrodes separate from the resistive zones with the control electrodes associated with said zones and control electrodes not associated with resistive zones.

In a third embodiment (parts E and F of FIG. 7), the source 80 or 82 has an extraction gate 98 or 100.

This gate serves as a polarizing electrode, which can be associated with a resistive zone.

It would also be possible to conceive a combination of the second and third embodiments.

2) The second method consists of depositing between two electrodes a plurality of elementary resistive zones having different resistances, in order to obtain potential profiles which are linear in part and monotonic, as is diagrammatically illustrated by parts G, H and I, J of FIG. 7, or where there are two elementary resistive zones 84*a*, 84*b* of different resistances. These parts G, H, I, J are respectively the homologues of parts A, B, E, F of FIG. 7, the zone 84 being replaced here by the zones 84*a*, 84*b*.

There are several ways for bringing about this second method and these have already been considered in connection with FIG. 5. In order to obtain zones of different resistances, it is possible a) to deposit several materials with different resistivities (cf. part D of FIG. 5 ) or a single material doped differently in each elementary zone, b) to deposit a layer of homogeneous thickness of a single material and locally etching it (cf. part E of FIG. 5), c) to deposit several layers of different thicknesses of the same material (cf. part C of FIG. 5), d) or combining two or three of these.

For the procedure indicated in c), it is possible to independently deposit layers of different thickness (cf. part C of FIG. 8, where it is possible to see two layers 78*a*, 78*b* of different thicknesses), or to form extra thicknesses by the overlap of layers (cf. part D of FIG. 8, where the layer 78*c* is overlapped or covered by the layer 78*d*).

In certain special embodiments, the invention makes it possible to both focus and deflect a bean from a source.

In the case of an elongated ion source (according to FIG. 6), with resistive zones on either side of said source, the beam is deflected on one side by imposing a slightly more attractive potential for the ions (i.e. higher in the case of negatively charged ions, but lower in the case of positively charged ions) on the resistive zone located on said same side.

In the case of a source surrounded by one or more resistive zones (cf. parts A and C of FIG. 7), the deflection can be combined with the refocusing by subdividing the resistive zone by dividing up a control electrode into several elementary polarizing electrodes imposing different potential profiles on the different sides of said zone.

In the case of FIG. 9, the central polarizing electrode 86 and the four elementary, peripheral, polarizing electrodes 88*a*, 88*b*, 88*c* and 88*d* make it possible to define four elementary resistive zones. The elementary resistive zone defined by the central polarizing electrode 86 and the refocusing electrode 88*b* is here quarter of the resistive zone 84.

It is clear that by imposing, by means of the electrode 88*b*, a more attractive potential for the ions in said zone, the bean is deflected from the side of said electrode 88*b*. A particularly advantageous embodiment of the invention is shown in FIG. 10. In this embodiment, the aim is to control the electron beam from a field effect micropoint source according to e.g. document (7).

On a substrate 102 are deposited micropoints 104 at the bottom of holes 106 formed through the extracting gate 108 in an insulating layer 110. The micropoints 104 are supplied by electrodes 112 through the resistive layer 114.

Around the zone defined by the edges 116 of the gate 108 and combining several micropoints, it is possible to deposit a bean control system according to the invention constituted by the resistive layer 118 above which is deposited the polarizing electrode 120. In this case the extracting gate 108 serves as the central polarizing electrode of the resistive zone.

The not shown extracting gate contact can in this case be easily brought from the periphery of the source by means of the stack of layers and the level difference between the electrodes 108 and 120.

Simulation software can be used for obtaining a system according to the invention. Each of the FIGS. 11 to 13 illustrates a focusing simulation of an electron bean. For simplification reasons, the details of the components of the electron bean control means are not shown (control electrodes and resistive zones). In each of these drawings, consideration has been given to a source with micropoints and an extracting gate G.

FIG. 11 corresponds to the case of a point source or a source having only a very limited extension compared with the dimensions of the refocusing optics, i.e. which uses one or more micropoints, as in FIG. 2. The beam control means MF (control electrodes and resistive zones) are raised to potentials such that the trajectories of the electrons are parallel to one another.

FIGS. 12 and 13 again illustrate the case of a micropoint source, which is a point source or a source having a very limited extension and which is provided with a focusing system having control electrodes.

In the case of FIG. 12, to the control electrodes are applied potentials so that the beam is focused at a point located on the collecting anode AC facing the source. In the case of FIG. 13 the possibility of deflecting said beam towards another point of the anode without losing the focusing property is shown. It is thus possible to focus the beam emitted by the electron source.

In FIG. 13, the source is of the same type as in FIG. 3, so that the control electrodes are elongated.

CITED DOCUMENTS (1) G. Chauvet, R. Baptist, Journ. of Electr. Spec. and Rel. Phen. 24, 255 (1981).

(2) Th. Fauster, F. J. Himpsel, J. J. Donelon and A. Marx, Rev. Sci. Instr. 54, 68 (1983).

(3) P. Grivet. Optique electronique. Vol. I: electrostatic lenses (Bordas, Paris, 1955) .

(4) J. R. Pierce, Theory and Design of Electron Beans. (D. Van Norstand, New York, 1954).

(5) H. Z. Sat-E1. Revised Theory of Pierce-type Electron Guns. Nucl. Instr. and Meth. 203, (1982) 21–33.

(6) H. C. Lange. Development and structure of a spectrometer for inverse photoemission with variable photon energy (in German), Berlin Free University, 1988.

(7) French patent application 8715432 of 6.11.1987, cf. also U.S. Pat. No. 4,940,916.

(8) H. Gundel, H. Riege, J. Handerek and K. Zioutas. Low pressure hollow cathode switch triggered by a pulsed electron beam emitted from ferroelectrics. Appl. Phys. Letters, 54 (21), 2971–3 (1989) .

(9) G. G. P. Van Gorkom and A. M. E. Hoeberechts. Silicon cold cathodes. Philip Technical Review. Vol. 43, No. 3, January. 1987.

We claim:

1. A system for controlling the shape of a charged particle beam, emitted from a particle source (32, 70, 80, 82), said source being associated with a collecting electrode for collecting these particles, said system comprising at least one resistive zone (56; 72; 78; 78*a*, 78*b*; 78*c*, 78*d*; 84; 84*a*, 84*b*; 90*a*, 90*b*; 118) and at least two control electrodes (48; 52, 54; 74, 76; 88; 86, 88*a* to 88*b*; 92, 94, 96; 88, 98; 88, 100; 108, 120), said resistive zone and said control electrodes being arranged substantially at the same level as the source, said control electrodes also being placed on either side of the resistive zone and serving to polarize the latter, the electric resistance profile of the resistive zone being chosen so as to have a potential distribution making it possible to obtain the desired shape of the beam from the source, when the control electrodes are appropriately polarized.

2. System according to claim 1, comprising a plurality of resistive zones respectively placed between two control electrodes, said resistive zones then being separated by at least one control electrode.

3. System according to claim 2, wherein the different resistive zones have different resistance profiles.

4. System according to claim 1, wherein each resistive zone comprises a plurality of elementary resistive zones (84*a*, 84*b*), whose respective electrical resistances are different from one another and which are between two control electrodes (86, 88; 88, 98).

5. System according to claim 4, wherein the respective thicknesses of these elementary resistive zones differ from one another and are chosen in such a way as to obtain the desired electric resistances.

6. System according to claim 4, wherein the respective resistivities of these elementary resistive zones differ from one another and are chosen so as to obtain the desired electric resistances.

7. System according to claim 4, wherein the respective resistive surfaces of these elementary resistive zones with the same length differ from one another and are chosen so as to obtain the desired electric resistances.

8. System according to claim 1, wherein the source comprises a particle extracting gate (98, 108), said gate constituting one of the control electrodes and is positioned in the center of the system, each other control electrode (88, 120) surrounding the source.

9. System according to claim 1, wherein each control electrode surrounds the source.

10. System according to claim 8, wherein at least one control electrode surrounding the source is discontinuous and forms a plurality of elementary control electrodes (88*a* to 88*d*).

11. System according to claim 1, wherein the source comprises a particle extraction gate (100) and has an elongated shape in one direction, said gate constituting one of the control electrodes and is positioned in the center of the system, the system having at least one other control electrode (88), which is elongated in said direction and is positioned on each side of the source and at least one resistive zone (84) extending between the gate and the other control electrode on each side of the source.

12. System according to claim 1, wherein the source (32, 82) has an elongated shape in one direction, the system comprising at least two control electrodes (48; 86, 88) elongated in said direction and located one each side of the source, and at least one resistive layer (72, 84) placed between the two electrodes on each side of the source.

13. System according to claim 1, further comprising said system being integrated into the charged particle source, which is a planar source.

14. System according to claim 1, wherein the control electrodes are planar and located substantially in the plane of the source.

15. System according to claim 9, wherein at least one control electrode surrounding the source is discontinuous and forms a plurality of elementary control electrodes.

16. System according to claim 1, wherein said particle source is a micron electron source comprising a grid for extracting electrons, micropoints and a conductive layer.

17. System according to claim 16, wherein said conductive layer is a cathode separated from said micropoints by a resistive layer.

18. System according to claim 17, wherein said grid is insulated from the conductive layer by an insulating layer.

19. System according to claim 17, wherein said grid is insulated from the resistive layer by a insulating layer.

20. System according to claim 17, wherein said grid is insulated from the conductive layer and the resistive layer by a insulating layer.

21. System according to claim 16, wherein said control electrodes are located around said receiving electron source and said at least one resistive zone is polarized by said control electrodes thereby imposing a potential distribution between said control electrodes so that said distributor is adapted to a shape and orientation of a desired beam.

* * * * *